US005173968A

United States Patent [19]

Fox

[11] Patent Number: 5,173,968

[45] **Date of Patent: * Dec. 29, 1992**

[54] ARTICLE COMPRISING AN ENVELOPING STRUCTURE

[75] Inventor: Flo Fox, New York, N.Y.

[73] Assignee: Peter Weiss, New York, N.Y.

[ * ] Notice: The portion of the term of this patent subsequent to Jun. 18, 2008 has been disclaimed.

[21] Appl. No.: 652,846

[22] Filed: Feb. 8, 1991

Related U.S. Application Data

[63] Continuation-in-part of Ser. No. 487,352, Feb. 28, 1990.

[51] Int. Cl.[5] ..... A41F 9/00

[52] U.S. Cl. ..... 2/244; 2/338; 2/310; 2/247; 2/108

[58] Field of Search ..... 2/170, 171.1, 171.2, 2/310, 311, 312, 338, 321, 322, 244, 247, 250, 791, 94, 108, 227; 40/586, 596, 618; 446/27, 28; 224/158

[56] References Cited

U.S. PATENT DOCUMENTS

| | | | |
|---|---|---|---|
| 226,658 | 4/1880 | Graydon | 2/338 X |
| 689,352 | 12/1901 | Buffington | 2/338 |
| 802,558 | 10/1905 | Gausman | 2/332 |
| 1,060,229 | 4/1913 | Casper & Clark | 2/338 |
| 1,467,680 | 9/1923 | Oda | 2/247 X |
| 1,553,916 | 9/1925 | Rose | 2/338 |
| 1,718,622 | 6/1929 | Zeller | 40/618 |
| 1,756,547 | 4/1930 | Hansen | 40/618 |
| 1,963,309 | 6/1934 | Muller | 2/338 |
| 2,192,883 | 3/1940 | Forstner | 40/618 |
| 2,321,808 | 6/1943 | Govan | 2/321 |
| 2,339,239 | 1/1944 | Carmichael | 2/311 X |
| 2,378,755 | 6/1946 | Dowling | 2/300 |
| 2,427,119 | 9/1947 | Bensel | 2/338 |
| 2,803,829 | 8/1957 | Tscharner | 2/199 X |
| 2,821,635 | 1/1958 | Bailen | 2/338 |
| 2,871,485 | 2/1959 | Greco | 2/247 |
| 3,055,133 | 9/1962 | Anderson | 40/586 |
| 3,078,469 | 2/1963 | Lynam | 2/338 |
| 3,214,852 | 11/1965 | Ford et al. | 40/586 X |
| 3,521,798 | 8/1970 | Hill | 2/338 X |
| 4,062,066 | 12/1977 | Weiss | 2/322 |
| 4,144,594 | 3/1979 | Chapman | 2/338 |
| 4,151,936 | 5/1979 | Hawkes | 2/321 X |
| 4,340,976 | 7/1982 | Wright | 2/338 |
| 4,446,574 | 5/1984 | Kalomeris | 2/338 |
| 4,521,923 | 6/1985 | Mackey | 2/338 |
| 4,557,215 | 12/1985 | Petersson | 2/170 X |
| 4,581,271 | 4/1986 | Gordon | 2/311 X |
| 4,602,390 | 7/1986 | Morera et al. | 2/247 |
| 4,918,758 | 4/1990 | Renduna | 2/171 |
| 4,924,613 | 5/1990 | Levin | 40/586 |
| 4,999,848 | 3/1991 | Oney | 2/115 |
| 5,023,956 | 6/1991 | Fox | 2/338 |

FOREIGN PATENT DOCUMENTS

| | | | |
|---|---|---|---|
| 2509144 | 1/1983 | France | 2/338 |
| 526150 | 5/1985 | Italy | 2/322 |

*Primary Examiner*—Werner H. Schroeder
*Assistant Examiner*—Jeanette E. Chapman
*Attorney, Agent, or Firm*—Jordan and Hamburg

[57] ABSTRACT

An article is constituted of pieces of self-cohesive, pliable plastic which form a well sealed enveloping structure which may be manually unsealed and opened for the insertion of decorative or information conveying material and then manually be closed again and well resealed, at least one piece of the plastic being transparent, then at least one piece being selected so as to permit viewing of decorative or information conveying material in the enveloping structure.

19 Claims, 5 Drawing Sheets

FIG. 9
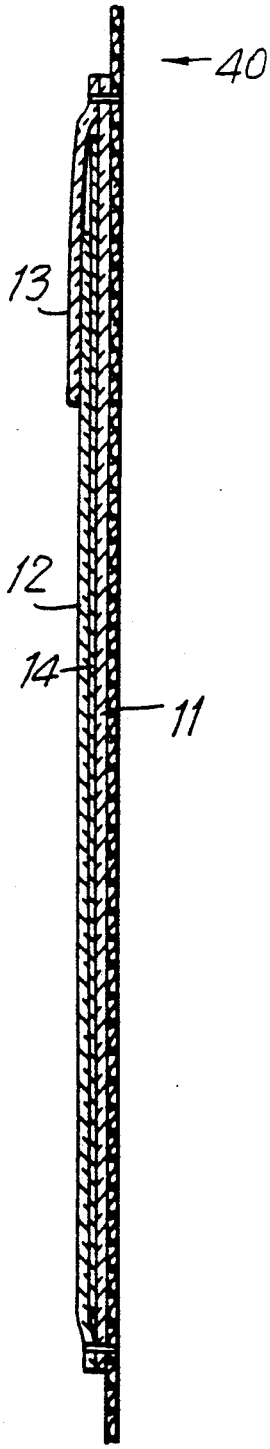
FIG. 10
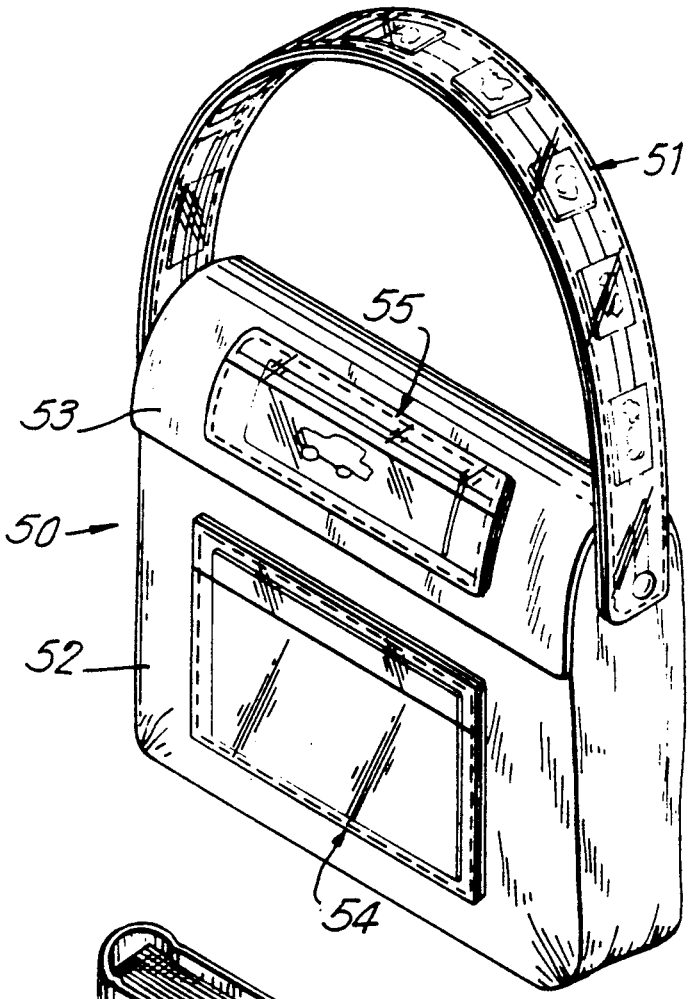
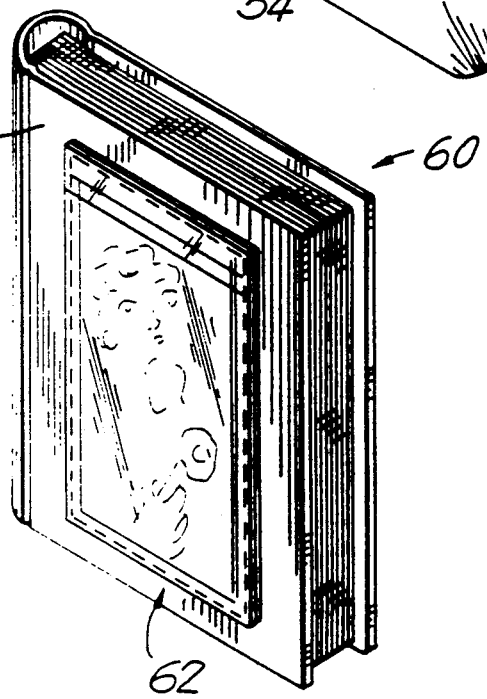
FIG. 11

FIG. 12
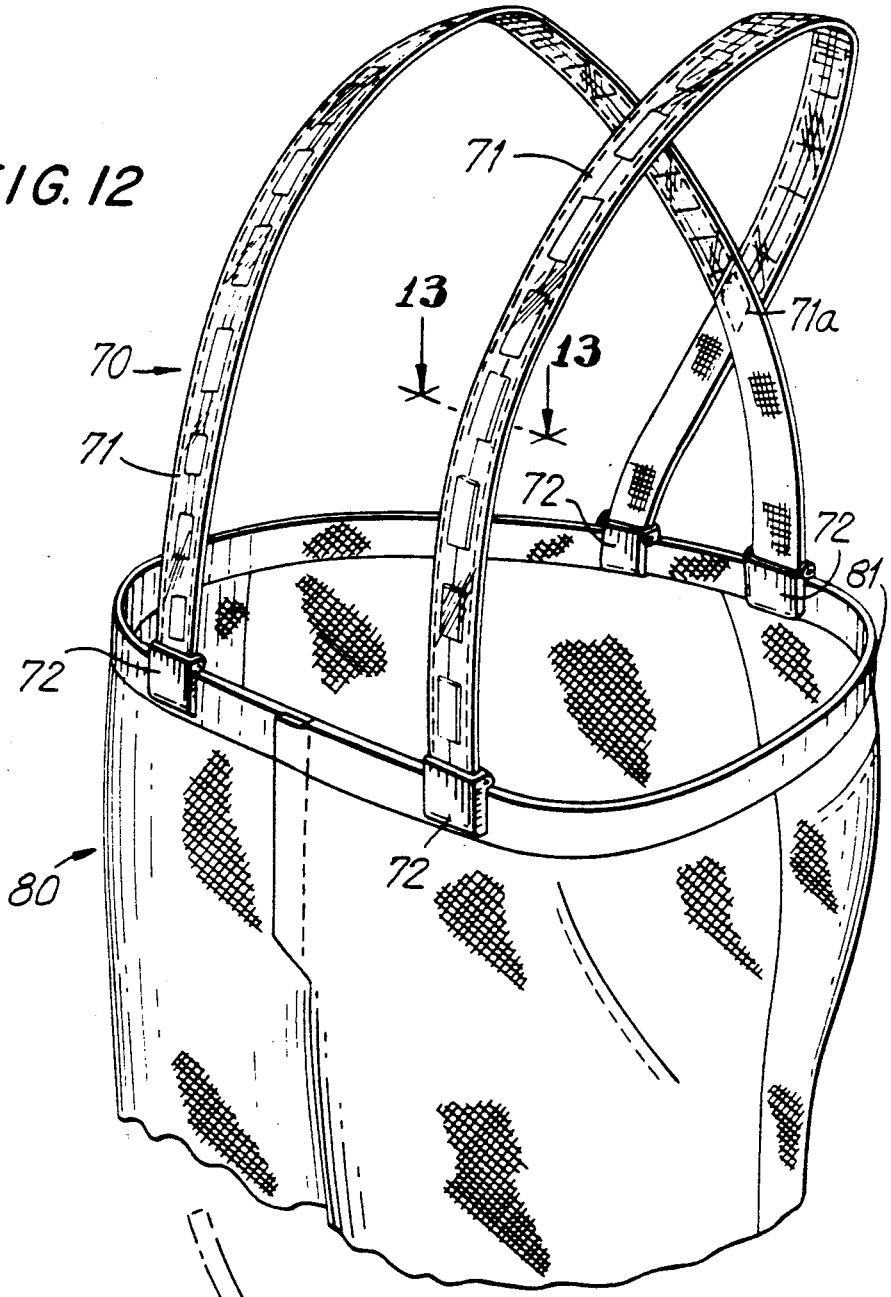
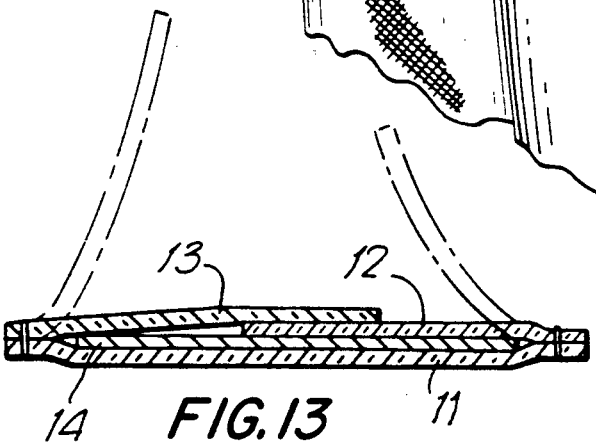
FIG. 13
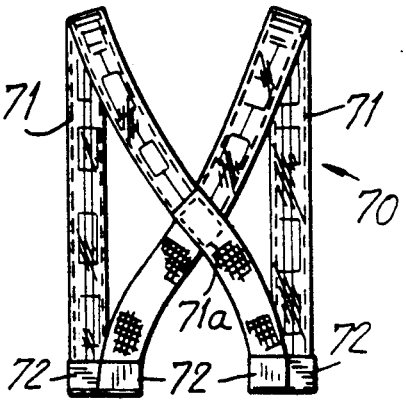
FIG. 14

ARTICLE COMPRISING AN ENVELOPING STRUCTURE

REFERENCE TO RELATED APPLICATION

This is a continuation-in-part of application Ser. No. 487,352, filed Feb. 28, 1990.

BACKGROUND OF THE INVENTION

This invention relates to an article comprising an enveloping structure. More particularly, the enveloping structure of this invention comprises transparent plastic sheeting so that photographs or other decorative or information conveying matter, preferably relatively flat or small, can be inserted therein for display. The enveloping structure may comprise an article of apparel but there are many other applications therefor.

In U.S. Pat. No. 1,060,229, there has been proposed an article of apparel consisting of an elongated body, preferably of soft leather, having a series of spaced openings formed along its length and a strip of transparent celluloid secured against one face of the body over the openings and formed with spaced longitudinal flanges for receiving a plurality of display cards, the edges of the body being inturned upon the flanges of the strip, the body and inturned edges thereof being secured to the strip and its flanges by a series of stitchings. The spaced openings are not sealed. This permits the cards to slip out partially, which is detrimental to the appearance of the article of apparel, or to be lost altogether, and also permits the interior face of the celluloid to become soiled. Moreover, celluloid is flexible but not pliable. Consequently, when the article of apparel is one which, like a belt, encircles a portion of the body wearer, the stressing of the celluloid resulting from the curvature imparted to the article of apparel when it encircles a body part of the wearer will cause the openings in the celluloid to gap, aggravating the aforementioned problems.

In U.S. Pat. No. 2,596,884, there has been proposed a waist belt having front and rear layers at least one of which extends substantially the full length of the belt substantially throughout its width. The layers are secured together along narrow spaced vertically extending areas to form a plurality of pockets at closely spaced positions along a substantial length of the belt. The pockets have openings adapted to receive inserts. The front layer of the belt is sufficiently transparent to make the inserts visible against the inner faces of the front layer. The layers are joined by heat sealing or by cementing with the use of solvent or cement. Rubber hydrochloride or polymeric vinyl chloride/vinyl acetate containing a high proportion of plasticizer are suggested plastics but the patent indicates that the choice of plastic is not part of the invention. The pockets do not seal, facilitating displacement or loss of the inserts and soiling of the interior of the pockets.

SUMMARY OF THE INVENTION

It is an object of the invention to provide an article comprising an enveloping structure adapted to display decorative or information conveying matter, preferably relatively flat or small, inserted therein, which avoids the disadvantages of the prior art.

Other objects and advantages of the invention will be apparent from the following description of the invention.

According to the invention, there is provided an article comprising an enveloping structure adapted to display decorative or information conveying matter, which matter preferably is relatively flat or small, securely and sealed against the entry of foreign matter. The article is constituted of three pieces of self-cohesive, pliable plastic sheeting which are substantially coextensive in a first planar dimension thereof and are not coextensive in a second planar dimension thereof normal to the first planar dimension. A first of the pieces has mutually opposed lateral edges coextensive with the first planar dimension. The second and third pieces each have a lateral edge attached to a respective one of the lateral edges of the first piece. The second and third pieces are each smaller than the first piece in the second planar dimension and each have a free lateral edge. The combined second planar dimensions of the second and third pieces is greater than the second planar dimension of the first piece so that the second and third pieces have mutually overlapping lateral portions contiguous with their respective free lateral edges. The first, second and third pieces thereby form an enveloping structure. The pliability of the sheeting permits the overlapping portions of the second and third pieces to be manually peeled away from each other thereby to provide access to the interior of the enveloping structure for insertion or removal of decorative or information conveying matter, preferably relatively flat or small, and then to be mutually overlapped again. The self-cohesiveness of the plastic sheeting causes the overlapping portions to cohere sufficiently to remain sealed when not being subjected to manual peeling. At least one of the pieces of plastic is transparent, the at least one piece being selected so as to permit viewing of decorative or information conveying material in the enveloping structure.

In specific exemplary embodiments of the invention illustrated herein, the article according to the invention is a waist belt, a jacket epaulet, a pocket or a plurality of contiguous pockets on the front, sleeves, upper back or yoke or lower back of a jacket, a strap of and pockets on the outer surfaces of a woman's handbag; a pocket on the cover of a book or book binder and the straps of suspenders. Other examples of articles embodying the invention or onto which articles embodying the invention may be fastened are, without limitation, headbands, hairbands, wristbands, neckties, vests, wallets, brassieres, earrings, hatbands, watchbands, shoes, pillows and packing list holders.

BRIEF DESCRIPTION OF THE DRAWINGS

The invention will be further described by reference to a preferred embodiment as illustrated in the drawings, in which:

FIG. 9 is a sectional view on section line 9—9 of FIG. 7;

FIG. 10 is an isometric view of a handbag according to the invention;

FIG. 11 is an isometric view of a looseleaf binder or book according to the invention;

FIG. 12 is an isometric view of suspenders according to the invention fastened to a trousers waistband;

FIG. 13 is a sectional view on section line 13—13 of FIG. 12; and FIG. 14 is a rear elevation view of the suspenders of FIG. 13.

DETAILED DESCRIPTION OF THE PREFERRED EMBODIMENTS

Figure 1:
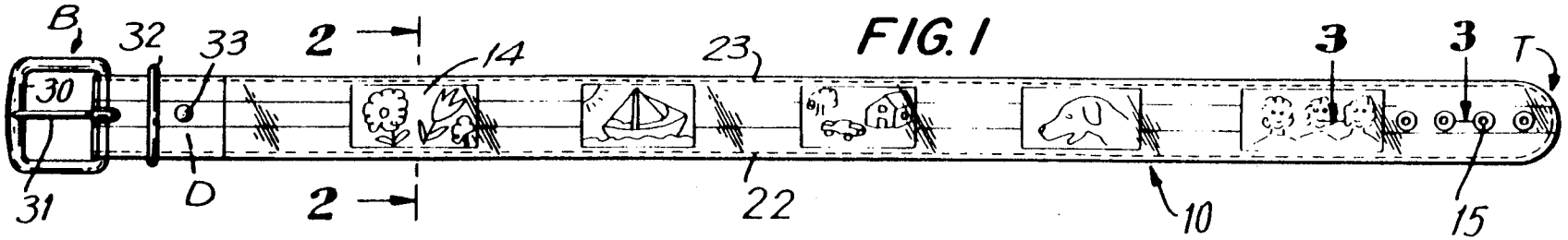
FIG. 1 is a plan view of a waist belt according to the invention.

A waist belt 10 (FIGS. 1, 2, 3) according to the invention is constituted of three pieces of self-cohesive, pliable transparent plastic sheeting, 11, 12 and 13 which are substantially coextensive in one planar dimension thereof (in this case, length) and are not coextensive in the planar dimension thereof normal to the aforementioned planar dimension (in this case, width). Self-cohesiveness and pliability of the sheeting are essential. "Pliability" is a common term and should require no explanation for those of ordinary skill in the plastics fabrication arts. "Self-cohesiveness" refers to the property of pliable sheets of some plastics to cohere to each other. This is not a result of static electricity. Rather, it is a not well understood phenomenon presumably related to the surface molecular structure of the plastic. It has been found that pliable plastic sheeting consisting essentially of polyvinyl chloride, i.e., unplasticized polyvinyl chloride, is excellent in self-cohesiveness and, hence, is a preferred material for the practice of the present invention. This material, 100% polyvinyl chloride sheeting, is sometimes referred to in the trade as "virgin vinyl film sheeting."

The sheeting does not have adequate self-cohesiveness unless it is relatively soft. Suitably soft sheeting may be defined as sheeting having a Durometer of 1S to 6S, a Durometer of 4S being particularly preferred. Pliability and softness are related. A too hard material inherently will not be pliable. Pliability of unplasticized polyvinyl chloride sheeting is affected by ambient temperature and humidity, particularly the former. Low temperatures decrease pliability of the polyvinyl chloride sheeting. Durometer determinations are, by definition, made at room temperature. The hereinabove suggested Durometer ranges are such that the polyvinyl chloride sheeting will still be pliable when exposed to temperatures typical of temperate climate winters, e.g., generally no lower than about 0° F. and rarely below −10° F.

Since in the embodiment of FIGS. 1 to 3 the pieces 11, 12 and 13 are quite elongated, i.e., quite larger in one planar dimension than in the other, they are hereinafter alternatively referred to as "strips." In the drawings strips 11, 12 and 13 are illustrated as being of the same thickness. In practice, it is sometimes desirable, for product economy, durability and integrity, that the strip 11, the outer face **11*a* of which is the obverse face of the article 10, be of heavier gauge than the strips 12 and 13. For example, in one proposed commercial embodiment of the invention, the strip 11 is 0.030 gauge (i.e., 0.030" thick) whereas the strips 12 and 13** are 0.018 gauge (i.e., 0.018" thick).

To mutually opposed lateral edges **11*b* and 11*c* of the strip 11 are stitched respective lateral edges 13*b* and 12*c* of the strips 13 and 12 by means of respective rows of stitches 23 and 22 known as "top stitching." The rows of stitches 23 and 22** are in fact constituted of one seam of stitching extending also around the tip of the belt. The top stitching is illustrated schematically and, in actuality, as is well known, consists of two threads, one of which is on the back side and forms binding stitches which lock the front stitches. The threads constituting the top stitching may be 100% mercerized cotton. The sewing machine is preferably set at a medium thread tension setting. The result is a 3 to 5% residual shrinkage of the stitches, which assures that the stitches tightly seal together the edges of the strips. Cotton thread is inexpensive and the color thereof, whether white or black or some other color, is decorative. However, as cotton thread is not particularly strong and may be particularly deficient in strength (a) if white and the manufacturer thereof made it white by bleaching thread of a color other than white which was dyed incorrectly or defectively or for which there was no immediate market or (b) if black due to the greater amount of dye carrier generally contained in a black thread as compared with threads of other colors. Therefore, according to another feature of the invention, the back stitches are preferably of a synthetic monofilament, such as nylon or polyester, preferably transparent, which costs more than cotton thread. The back stitches of such monofilament are relatively very strong and, therefore, maintain their integrity when the cotton top stitches suffer breakage, thereby keeping the top stitches in place and maintaining the integrity of the seam despite the top stitch breakage. Transparent monofilament may generally be stronger and less expensive than dyed or pigmented monofilament and will enable the manufacturer to stock only one monofilament, namely transparent, since it will not disrupt or clash with the decorative appearance provided by colored top stitches, regardless of the color of the top stitches. For environmental and safety reasons, stitching is preferred to heat sealing. Heat sealing of polyvinyl chloride results in emission of HCl, CO and $CO_2$, requiring special venting.

Strips 12 and 13 are narrower than strip 11 but have combined widths greater than the width of the strip 11. The result is that the strips 12 and 13 have mutually overlapping and cohering lateral portions contiguous with their respective free lateral edges **12*d* and 13*d* and the strips 11, 12 and 13 form a transparent enveloping structure. The pliability of the sheeting permits the mutually cohering overlapping portions of the strips 12 and 13 to be peeled away from each other thereby to provide access to the interior of the enveloping structure for the insertion or removal of relatively flat or small decorative or information conveying matter, such as photographs 14**, and then manually to be mutually overlapped and pressed into mutual coherence again. The self-cohesiveness of the plastic sheeting causes the overlapping portions, particularly with the assistance of finger pressure, to cohere sufficiently to remain sealed when not being subjected to the aforementioned manual peeling. The self-cohesiveness of the plastic also renders it cohesive with respect to other materials, such as photographic or other paper, whereby photographs and so forth inserted in the enveloping structure of the invention are held in place and do not slide about.

The waist belt 10 otherwise comprises conventional structure and hardware, namely, near the tip T several punched holes reinforced by metal eyelets 15, the holes being equally spaced in the lengthwise direction of the belt and being equidistant from opposed lateral edges of the belt, a buckle B consisting of a frame 30 and a tongue or prong 31 for being received in a selected metal eyelet 15, a keeper 32 for receiving the tip T of the belt, and one or more metal rivets 33 for fastening a doubled under portion D of the belt which secures the buckle B and the keeper 32. The strips 12 and 13 overlap in a sufficient width so that the punched holes pass through all three strips 11, 12 and 13 and all three strips 11, 12 and 13 are sandwiched between opposed annular flanges 15*a* and 15*b* of the eyelets 15.

It is not intended that the waist belt or other embodiments of the invention be limited to the specific embodiments herein illustrated. For example, in principle, plastic pieces 12 and 13 in the embodiment of FIGS. 1 to 3 need not be transparent and may be pigmented or dyed. However, the introduction of pigment or dye may decrease the self-cohesiveness of the strips and, moreover, obscure to the eyes of a prospective purchaser the decorative potential of the article.

The general specifications for the plastic pieces 11, 12 and 13 are applicable to other embodiments of the invention and, therefore, will not be repeated. As the plastic pieces and the stitches are essentially the same regardless of the embodiment, the same reference numbers are used throughout the specification and redundant verbal description is avoided. However, as the rows of stitches are all functionally essentially the same and as, in many instances, the stitches form a continuous row adjacent the perimeter of an enveloping structure according to the invention, the single reference number "22" is hereinafter used to designate all the stitches. Moreover, in some embodiments, the piece 11 does not constitute the obverse face of the article. In particular, in embodiments of the invention in which the enveloping structure is fastened to a substrate, the piece 11 is against the substrate to permit access into and out of the enveloping structure by the usual peeling of the piece 13 away from the piece 12 followed by recohering of the piece 13 onto the piece 12.

In another embodiment of the invention, onto jacket 40 (FIGS. 4–9) are stitched eight enveloping structures 41, 42, 43, 44, 45, 46, 47 and 48 according to the invention. Enveloping structures 41 and 42 are epaulets on the respective shoulders of the jacket 40. Enveloping structures 43 and 44 are pockets on the respective arms of the jacket 40. Enveloping structures 45, 46 are pockets on the respective left and right front panels of the jacket 40. Enveloping structure 47 is a row of three contiguous pockets on the upper back or yoke of the jacket 40. The same stitches 22 which fasten the respective pieces 11, 12, 13 into the integral enveloping structures 40 to 48 also fasten the enveloping structures 40 to 48 to the fabric of the jacket 40, with the piece 11 contacting the jacket 40 and the interior enveloping structure thereby being accessible by peeling the piece 13 away from the piece 12 to permit the insertion or removal of photographs 14 or other decorative or information conveying material followed by recohering of the piece 13 to the piece 12. Enveloping structure 47 is slightly different from the others in that stitches 22, by the provision of two extra vertical rows thereof, also divide the enveloping structure into three discrete compartments.

Figure 2:
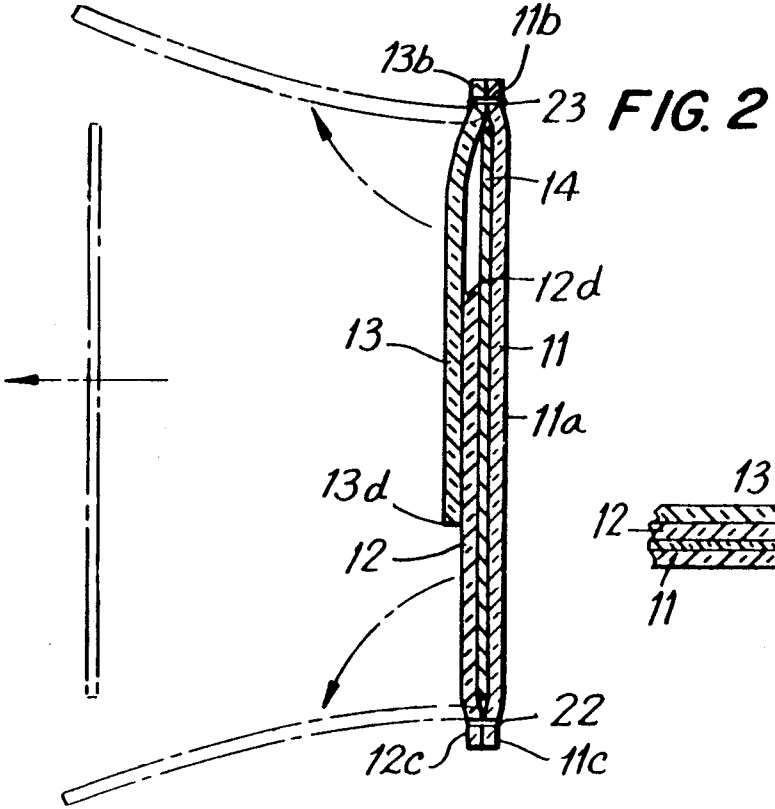
FIG. 2 is a sectional view thereof on section line 2—2 of FIG. 1.
Figure 3:
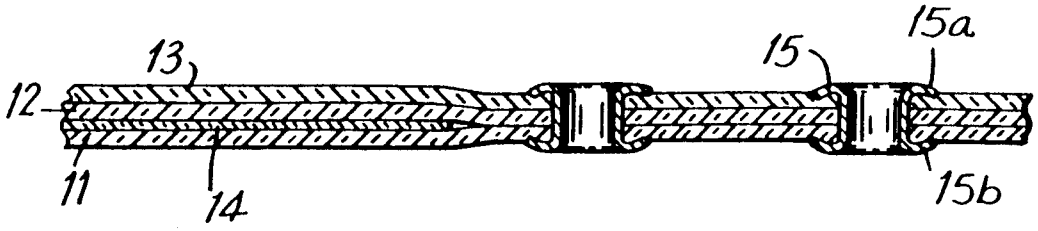
FIG. 3 is a sectional view thereof on section line 3—3 of FIG. 1.
Figure 4:
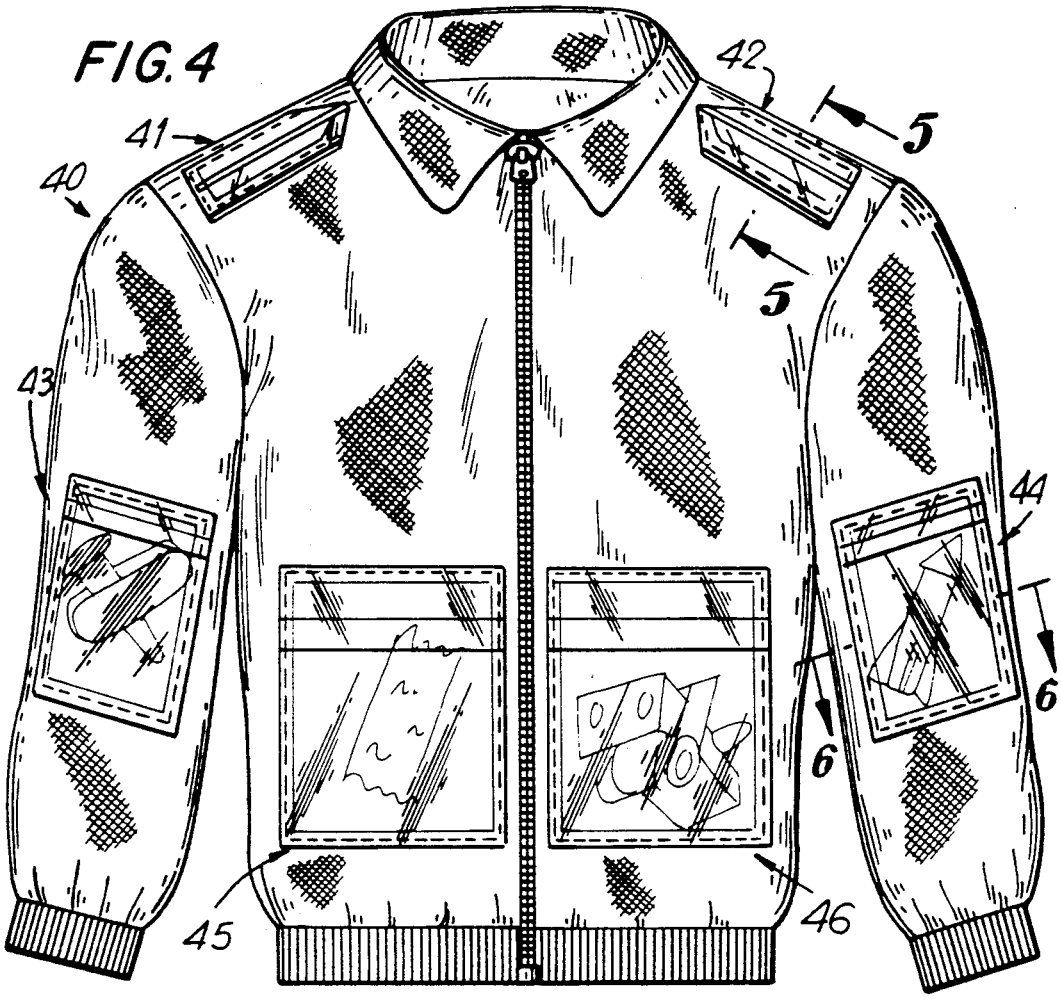
FIG. 4 is a front elevation view of a jacket according to the invention.
Figure 5:
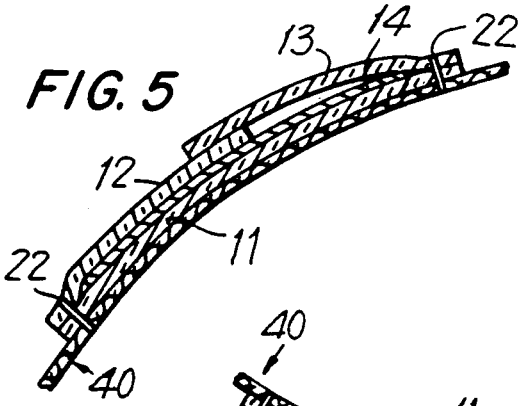
FIG. 5 is a sectional view on section line 5—5 of FIG. 4.
Figure 6:
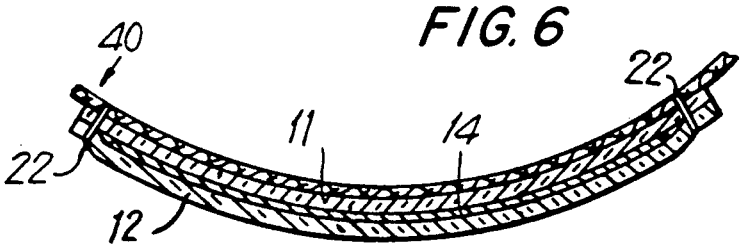
FIG. 6 is a sectional view on section line 6—6 of FIG. 4.
Figure 7:
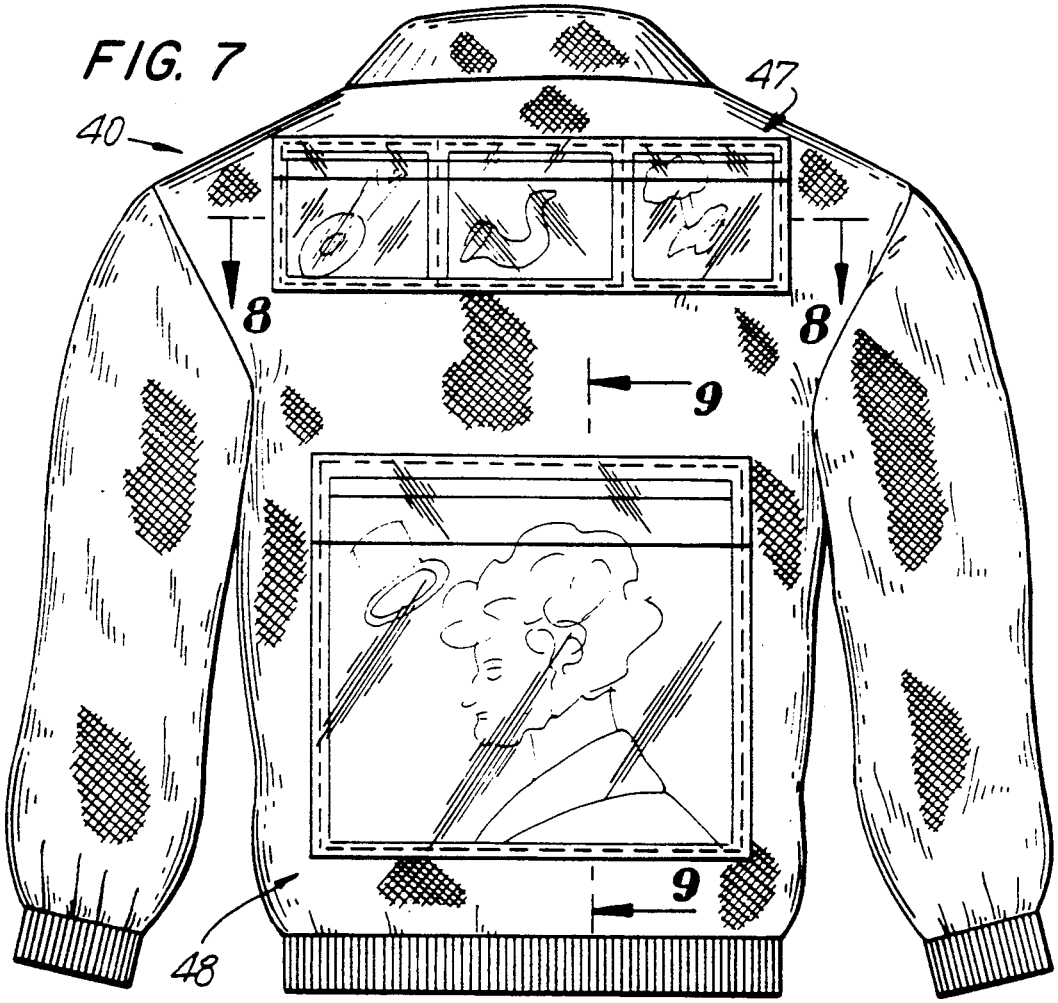
FIG. 7 is a rear elevation view of the jacket of FIG. 4.
Figure 8:
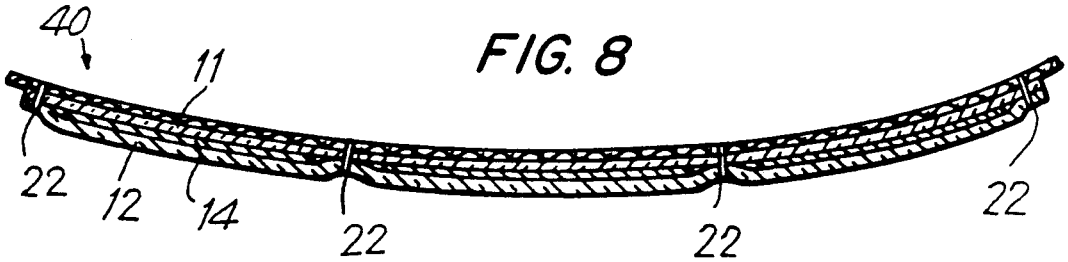
FIG. 8 is a sectional view on section line 8—8 of FIG. 7.

In another embodiment of the invention, handbag 50 (FIG. 10) comprises a carrying strap or handle 51 in the configuration of an elongated enveloping structure of the invention, similar to the belt 10 of the embodiment of FIGS. 1–3, with the piece or strip 11 forming the obverse face of the strap 51, a main body portion 52 with an enveloping structure 54 according to the invention stitched thereonto and a closure flap 53 with an enveloping structure 55 according to the invention stitched thereonto, the enveloping structures 54 and 55 being like and being fastened in the same manner as the enveloping structures 41 to 46 and 48 of the embodiment of FIGS. 4–9.

In the FIG. 11 embodiment of the invention, onto the cover 61 of a looseleaf or other binder or book is stitched an enveloping structure 62 according to the invention, the enveloping structure 62 being like and being fastened to the substrate in the same manner as the aforementioned enveloping structures which are fastened to a substrate.

In the FIGS. 12–14 embodiment of the invention, suspenders 70 comprises a pair of straps 71 each in the configuration of an elongated enveloping structure of the invention, similar to the belt 10 of the embodiment of FIGS. 1–3, with the respective pieces or strips 11 each forming the obverse face of a respective strap 71. In accordance with conventional suspenders structure and use, clips 72 are provided at each of the ends of the straps 71 and are releasably clipped to waistband 81 of trousers 80, and straps 71 cross over at the wearer's back and at their intersection are fastened together by stitches 71*a*. Straps embodying the enveloping structure of the invention may also be incorporated into suspenders of other conventional configurations and having other conventional means for fastening them to trousers.

What I claim is:

1. An article comprising an at least partially transparent enveloping structure, the structure comprising three pieces of self-cohesive, pliable plastic sheeting which are substantially coextensive in a first planar dimension thereof and are not coextensive in a second planar dimension thereof normal to the first planar dimension, a first of the pieces having mutually opposed lateral edges coextensive with the first planar dimension, the second and third pieces each having a lateral edge attached to a respective one of the lateral edges of the first piece, the second and third pieces each being smaller than the first piece in the second planar dimension and each having a free lateral edge, the combined second planar dimensions of the second and third pieces being greater than the second planar dimension of the first piece whereby the second and third pieces have mutually overlapping lateral portions contiguous with their respective free lateral edges, the first, second and third pieces thereby forming an enveloping structure, the pliability of the sheeting permitting the overlapping portions of the second and third pieces to be manually peeled away from each other thereby to provide access to the interior for insertion or removal of decorative or information conveying matter and then to be mutually overlapped again and the self-cohesiveness of the plastic sheeting causing the overlapping portions to cohere sufficiently to remain sealed when not being subjected to said manual peeling, at least one piece of the plastic being transparent, said at least one piece being selected so as to permit viewing of decorative or information conveying material in the enveloping structure.

2. An article according to claim 1, in which said attached lateral edges are stitched together.

3. An article according to claim 1, in which said stitches comprise cotton thread.

4. An article according to claim 3, in which the stitches are constituted of top stitching, the top stitching consisting of two threads, a first of the threads forming front stitches and a second of the threads forming binding stitches which lock the first stitches, the first thread being of cotton and the second thread being synthetic monofilament.

5. An article according to claim 4, in which the monofilament is transparent.

6. An article according to claim 4, in which the monofilament is nylon or polyester.

7. An article according to claim 1, in which said sheeting consists essentially of polyvinyl chloride.

8. An article according to claim 2, in which said sheeting consists essentially of polyvinyl chloride.

9. An article according to claim 3, in which said sheeting consists essentially of polyvinyl chloride.

10. An article according to claim 4, in which said sheeting consists essentially of polyvinyl chlorides.

11. An article according to claim 5, in which said sheeting consists essentially of polyvinyl chloride.

12. An article according to claim 6, in which said sheeting consists essentially of polyvinyl chloride.

13. An article according to claim 1, the article comprising suspenders, the enveloping structure comprising straps of the suspenders.

14. An article according to claim 1, the article comprising a handbag, the enveloping structure comprising a strap of the handbag.

15. A combination of an article according to claim 1 and a substrate to which the article is fastened.

16. A combination according to claim 9 in which the substrate is a garment.

17. A combination according to claim 16 in which the garment is a jacket.

18. A combination according to claim 15 in which the substrate is a book binder or cover.

19. A combination according to claim 15 in which the substrate is a handbag.

* * * * *